US006979142B1

(12) United States Patent
Chmelar

(10) Patent No.: US 6,979,142 B1
(45) Date of Patent: Dec. 27, 2005

(54) RETRACTABLE TIP MECHANICAL PENCIL ASSEMBLY

(76) Inventor: Erik Vaclav Chmelar, 371 Elan Village La., Apt. 112, San Jose, CA (US) 95134

( * ) Notice: Subject to any disclaimer, the term of this patent is extended or adjusted under 35 U.S.C. 154(b) by 0 days.

(21) Appl. No.: 11/004,553

(22) Filed: Dec. 6, 2004

(51) Int. Cl.[7] ..... B43K 21/22
(52) U.S. Cl. ..... 401/92; 401/65
(58) Field of Search ..... 401/65, 92, 93, 401/55, 56, 52

(56) References Cited

U.S. PATENT DOCUMENTS

| | | | | |
|---|---|---|---|---|
| 1,473,090 A | | 11/1923 | Ferry | |
| 1,580,183 A | | 4/1926 | Veillette | |
| 2,069,462 A | | 2/1937 | Rouse | |
| 2,815,002 A | | 12/1957 | Mayes | |
| 3,883,253 A | * | 5/1975 | Naruse et al. | 401/65 |
| 4,358,210 A | * | 11/1982 | Hashimoto et al. | 401/65 |
| 4,899,419 A | | 2/1990 | Saleen | |
| 5,127,130 A | | 7/1992 | Copito | |
| 5,356,232 A | * | 10/1994 | Skinner | 401/65 |
| 5,555,602 A | | 9/1996 | Leamond | |
| 5,882,132 A | * | 3/1999 | Kageyama et al. | 401/65 |
| 6,082,916 A | * | 7/2000 | Kageyama et al. | 401/65 |
| 6,732,407 B2 | | 5/2004 | Weiss | |
| 6,758,617 B2 | * | 7/2004 | Sakaoka | 401/92 |
| 6,817,800 B2 | * | 11/2004 | Sung | 401/92 |

FOREIGN PATENT DOCUMENTS

EP 0219001 A1 * 4/1987 ..... B43K 21/20

* cited by examiner

*Primary Examiner*—Khoa D. Huynh

(57) ABSTRACT

A mechanical pencil assembly including an eraser detachably secured to the writing end thereof, said eraser defining a bore therethrough, diameter of said bore larger than the diameter of the writing tip of said mechanical pencil such that said writing tip can be projected therethrough when writing is desired and retracted therefrom when erasure is desired. The need for a user to adjust his or her grip of the mechanical pencil assembly to transition from writing to erasure or from erasure to writing is completely eliminated, making both transitions nearly immediate and nearly effortless. A further feature of the present invention is a first storage compartment disposed within said barrel wherein additional pencil leads can be stored and a second storage compartment disposed within said barrel wherein additional erasers can be stored.

14 Claims, 10 Drawing Sheets

RETRACTABLE TIP MECHANICAL PENCIL ASSEMBLY

BACKGROUND OF THE INVENTION

The present invention relates generally to a mechanical pencil assembly including an eraser detachably secured to the writing end thereof, said eraser defining a bore therethrough, diameter of said bore larger than the diameter of the writing tip of said mechanical pencil assembly such that said writing tip can be projected therethrough when writing is desired and retracted therefrom when erasure is desired. A further feature of the present invention is a first storage compartment within said pencil wherein additional pencil leads can be stored and a second storage compartment within said pencil wherein additional erasers can be stored.

When writing, drawing, or otherwise using a writing utensil to mark upon a surface, hereafter called writing, erroneous marks can occur. It has become common practice to secure an eraser to the end of a writing utensil opposite the writing end, hereafter called the non-writing end, that can be readily used for erasure. However, to use said eraser, said writing utensil must be turned around to position said eraser at the writing surface, which is a great inconvenience.

Several devices has been proposed to permit erasure via an eraser secured to a writing utensil without requiring said writing utensil to be turned around. One solution is to statically secure an eraser near the writing tip of a writing utensil such that erasure can be accomplished by slightly moving said writing utensil to position said statically secured eraser near the writing surface.

U.S. Pat. No. 6,732,407 (Weiss) discloses a writing implement, which generally comprises a forward-positioned eraser that circumscribes the shaft of the writing implement and that may have an annular or doughnut shape.

U.S. Pat. No. 5,555,602 (Leamond) discloses an eraser device, which generally comprises an elongated cylindrical finger grip section with an internal bore defined therethrough, an internal conical bore section that is aligned with the internal bore so that the device can be slid or fitted onto the writing end of a writing instrument, and at least one eraser arm that extends radially outward from the finger grip section, is angled forward towards the front end of the device, and is configured with an eraser such that an operator can use the eraser by merely tilting and rotating the finger grip section to bring the eraser arm and eraser into contact with a writing surface.

U.S. Pat. No. 4,899,419 (Saleen) discloses a pencil eraser assembly having an elongated hollow eraser sleeve formed to align in elemental parallel spaced relationship with both the frustum shaped segment and the portion of the cylindrical barrel segment of a pencil, in which the sleeve has an opening adjacent to the end point of the frustum segment for holding an elongated eraser plug within the sleeve and adjacent to the pencil lead of the pencil.

Some disadvantages of the preceding devices are that they can be ineffective, obstruct the writing surface, or otherwise obstruct normal writing procedures. Another solution to permit erasure via an eraser secured to a writing utensil without requiring said writing utensil to be turned around is to secure a projectable and retractable eraser on the writing end of said writing utensil such that said eraser can be projected when erasure is desired and retracted when writing is desired.

U.S. Pat. No. 2,815,002 (Mayes) discloses an eraser for mechanical pencils, which generally comprises an eraser that is provided with a centrally disposed longitudinally positioned opening through which the lead extends and which is positioned at the base of the conical-shaped section of the point of the pencil and is slidably mounted and adapted to be actuated by a button on the surface of a barrel of the pencil wherein, should it be desired to make an erasure, the eraser is actuated by the button to slide outwardly beyond the point of the lead with the surrounding conical-shaped portion of the pencil expanding, whereby an erasure may be made and, after completing the erasure, the eraser is adapted to be retracted by the button and the point adapted to be used for writing.

U.S. Pat. No. 2,069,462 (Rouse) discloses a eraser that can be readily projected or extended to cover the writing point of a pencil so that an erasure can be made with the same end of the pencil as is used for writing, which generally comprises a tubular eraser attached to a member that is allowed to slide freely on the tube of a mechanical pencil by means of a force applied by one of the fingers and a spring that provides a restoring force to retract the member when released by the finger used to extend the member.

U.S. Pat. No. 1,580,183 (Veillette) discloses a writing implement with the eraser on the same end as the writing point, which generally comprises an eraser adapted to slidably telescope the writing point by means of a slight movement by one of the fingers during writing and which may then be pulled back by a similar movement of the finger.

U.S. Pat. No. 1,473,090 (Ferry) discloses an attachment for lead pencils that is disposed adjacently to the sharpened end of a pencil where it will not inconvenience the writer, which generally comprises a clasp and an erasing block and may have a sliding movement to dispose the attachment at or below the sharpened end of the pencil for erasing.

A disadvantage of the directly preceding devices is that they can be inconvenient to use since either a constant force must be applied by a writing finger to project and keep projected the eraser, a constant force must be applied by a writing finger retract the eraser which causes that writing finger to come to rest at a position not ideal for writing, or both. Another solution to permit erasure via an eraser secured to a writing utensil without requiring said writing utensil to be turned around is to secure an eraser on the writing end of said writing utensil and permit the writing tip to be projected when writing is desired and retracted when erasure is desired.

U.S. Pat. No. 5,127,130 (Copito) discloses a pencil eraser or erasable ink ball point pen eraser in the shape and form of a cowling sleeve affixed to the front end of either a double-acting mechanical pencil or single-acting ball point pen, wherein the writing elements of the pencil or pen may be withdrawn through spring action, making the eraser available for almost immediate application at the writing end of either instrument to erase whatever writing is to be erased.

Because the directly preceding device makes use of a double-acting mechanical pencil or a single-acting ball point pen, it lacks an effective and convenient means to both project and retract the writing tip and, as it relates to a mechanical pencil, lacks an effective and convenient means to advance a pencil lead forward through the writing tip. Accordingly, what is desired, and not heretofore been developed, is a writing utensil assembly wherein the transition from writing to erasure and from erasure to writing is nearly immediate and nearly effortless. Furthermore, what is desired, and not heretofore been developed, is a writing utensil assembly that includes an eraser secured to the front end thereof and a writing tip that is projectable and retractable wherein the writing fingers rest in the writing position after they are used to project the writing tip towards the writing surface, the writing fingers rest in the erasure position after they are used to retract the writing tip away from the writing surface, and as it relates to mechanical pencils, the desired writing finger permanently rests on or conveniently near a lead-advancing knock member.

BRIEF SUMMARY OF THE INVENTION

It is an object of the present invention to provide a mechanical pencil assembly wherein the transition from writing to erasure and from erasure to writing is nearly immediate and nearly effortless.

It is an object of the present invention to provide a mechanical pencil assembly including a tubular eraser detachably secured to the writing end thereof through which the writing tip can be projected when writing is desired and retracted when erasure is desired.

It is object of the present invention to provide a means of projecting the writing tip from the retracted position for erasure to the projected position for writing.

It is object of the present invention to provide a means of projecting the writing tip from the retracted position for erasure to the projected position for writing such that the writing fingers rest in the writing position thereafter.

It is object of the present invention to provide a means of retracting the writing tip from the projected position for writing to the retracted position for erasure.

It is object of the present invention to provide a means of retracting the writing tip from the projected position for writing to the retracted position for erasure such that the writing fingers rest in the erasure position thereafter.

It is object of the present invention to provide a means of advancing a pencil lead forward through the writing tip.

It is object of the present invention to provide a means of advancing a pencil lead forward through the writing tip such that the desired writing finger permanently rests on or conveniently near the lead-advancing knock member.

It is object of the present invention to provide a means of locking the writing tip in the projected position for writing.

It is object of the present invention to provide a means for storage of additional pencil leads within the mechanical pencil assembly.

It is object of the present invention to provide a means for storage of additional tubular erasers within the mechanical pencil assembly.

It is object of the present invention to provide a mechanical pencil assembly that is inexpensive to manufacture.

It is object of the present invention to provide a mechanical pencil assembly that is easy to use.

It is object of the present invention to provide a mechanical pencil assembly that is esthetically pleasing.

DETAILED DESCRIPTION OF THE INVENTION

Figure 1:
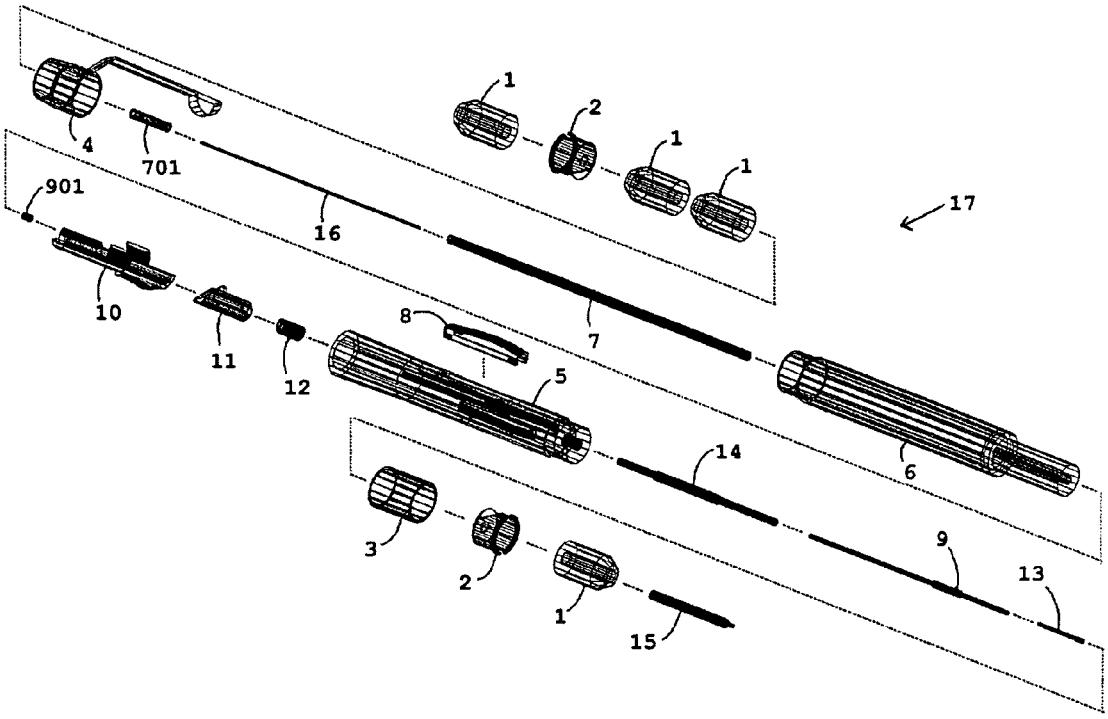
FIG. 1 is a perspective view of the parts comprising the mechanical pencil assembly of the preferred embodiment of the present invention.

FIG. 1 shows a perspective view of each part of the mechanical pencil assembly 17 of the present invention, generally comprising a front barrel 5 and a rear barrel 6, in which is disposed a first slide member 10, a second slide member 11, a spring 12, a lead guide tube 9, a funnel-shaped member 901, a chuck 13, a chuck guide 14, a tip 15, a lead storage tank 7, and a tank cap 701. On the front end of the front barrel 5 is secured a front flange 3, an eraser cup 2, and a tubular eraser 1, and within a side of the front barrel 5 is secured a knock member 8. On the rear end of the rear barrel 6 is secured a rear flange 4, an eraser cup 2, and a tubular eraser 1. The lead storage tank 7 stores additional pencil leads 16 and the rear barrel 6 stores additional tubular erasers 1.

Figure 2:
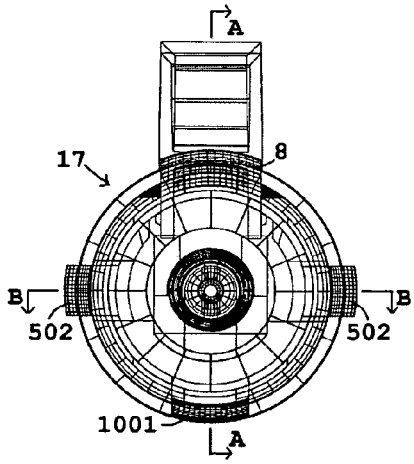
FIG. 2 is a front elevation view of the mechanical pencil assembly shown in FIG. 1 fully assembled.

FIG. 2 shows a front elevation view mechanical pencil assembly 17 shown FIG. 1 fully assembled. During writing or erasure the user holds the mechanical pencil assembly 17 in the same manner, with the index finger resting on or near the knob 1001 to project the writing elements of the mechanical pencil assembly 17 for writing, with the thumb resting on or near one of the retraction buttons 502 and the middle finger resting on or near the other retraction button 502 to retract the writing elements for erasure, and with the thumb resting on or near the knock member 8 to advance a pencil lead 16, such that the transition from writing, when the writing elements are projected and a pencil lead 16 is extended thereout, to erasure, when the writing elements are retracted, as well as the transition from erasure to writing, is accomplished simply by applying force with the appropriate finger or fingers.

Hereafter the term writing elements is used to describe the assembly comprising the first slide member 10, chuck guide 14, second slide member 11 lead guide tube 9, funnel-shaped member 901, chuck 13, tip 15, and pencil lead 16. Hereafter the term projected is used to describe the position of the writing elements of the mechanical pencil assembly 17 at a forward position such that the front-most point of the tip 15 is disposed in front of the front-most point of the tubular eraser 1 secured to the front end of the front barrel 5 and a pencil lead 16 is extended thereout a distance suitable for writing to permit writing. Hereafter the term retracted is used to describe the state of the writing elements of the mechanical pencil assembly 17 at a rearward position such that the front-most point of a pencil lead 16 extending out from the tip 15 a distance suitable for writing is disposed behind the front-most point of the eraser cup 2 secured to the front end of the front barrel 5 to permit erasure.

Figure 3A:
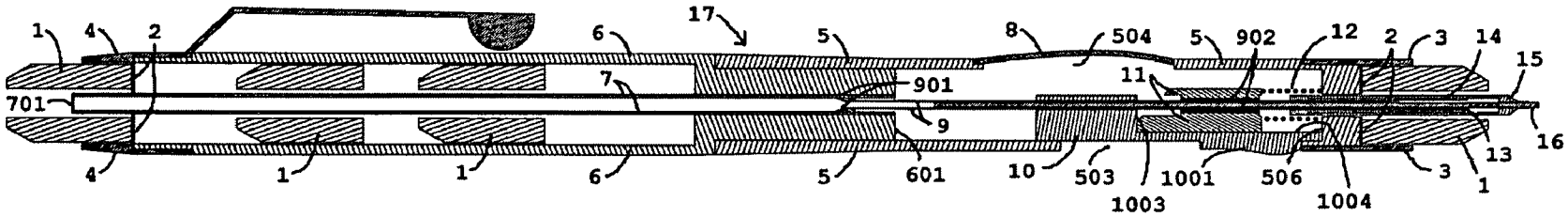
FIG. 3*a* is a cross-sectional view of the mechanical pencil assembly shown in FIG. 2 taken along the line A—A when the writing elements are projected for writing.

FIG. 3*a* shows a cross-sectional view of the mechanical pencil assembly 17 shown in FIG. 2 taken along the line A—A when the writing elements of the mechanical pencil assembly 17 are projected. The front barrel 5 and rear barrel 6 are joined to comprise the generally cylindrical barrel of the mechanical pencil assembly 17. On the front end of the front barrel 5 is secured a front flange 3, within which are detachably secured an eraser cup 2 and a tubular eraser 1. On the rear end of the rear barrel 6 is secured a rear flange 4, within which are detachably secured an eraser cup 2 and a tubular eraser 1.

An assembly comprising a lead storage tank 7 and a tank cap 701 is axially secured within the rear barrel 6 for storage of additional pencil leads 16 therein. Additional pencil leads 16 are placed therein or removed therefrom by removing the tubular eraser 1 and eraser cup 2 detachably secured to the rear end of the rear barrel 6 and removing the tank cap 701 detachably secured to the lead storage tank 7.

The outer diameter of the assembly comprising the lead storage tank 7 and tank cap 701 is smaller than the bore defined through the tubular eraser 1 and the inner diameter of the rear barrel 6 is larger than the outer diameter of the tubular eraser 1 to permit additional tubular erasers 1 to be stored axially within the rear barrel 6. Additional tubular erasers 1 are placed therein or removed therefrom by removing the tubular eraser 1 and eraser cup 2 detachably secured to the rear of the rear barrel 6.

The lead guide tube 9 with a funnel-shaped member 901 secured at the rear end thereto and a chuck 13 secured at the front end thereto is secured to the second slide member 11 via the projecting members 902. The chuck 13 is axially disposed within the chuck guide 14 secured to the first slide member 10. A tip 15 is detachably secured to the front end of the chuck guide 14 to guide a pencil lead 16 out from the front end of the mechanical pencil assembly 17 upon actuation of the knock member 8 disposed within the knock member opening 504 defined within a side of the front barrel 5.

A spring 12 is axially disposed within the front barrel 5 and about the chuck guide 14 and tip 15 to bias the writing elements rearward. The second slide member 11 is disposed in the channel 1004 defined on the first slide member 10. Rearward motion of the second slide member 11 is prevented by the stop element 1003 defined on the first slide member 10, and rearward motion of the first slide member 10 is prevented by two arm lock elements 505 (not shown) defined within the front barrel 5.

Figure 3B:
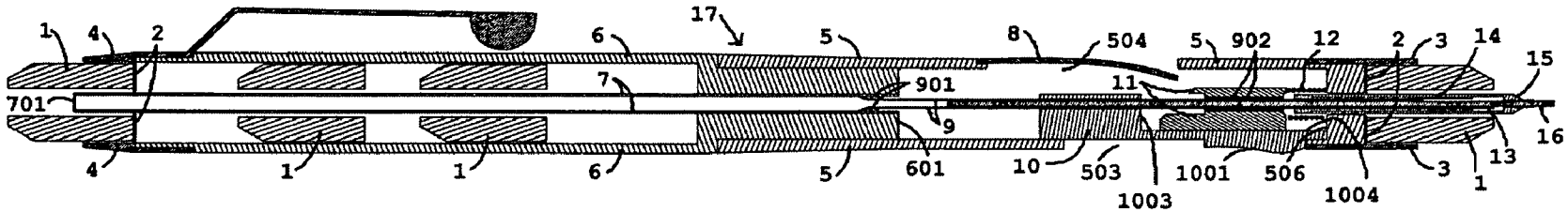
FIG. 3*b* is a cross-sectional view of the mechanical pencil assembly shown in FIG. 2 taken along the line A—A when the knock member is pressed to advance a piece of lead.

FIG. 3*b* shows a cross-sectional view of the mechanical pencil assembly 17 shown in FIG. 2 taken along the line A—A when the knock member 8 is pressed to advance a pencil lead 16. Actuation of the knock member 8 moves the second slide member 11, lead guide tube 9, funnel-shaped member 901, chuck 13, and pencil lead 16 forward against the rearward bias force of the spring 12. Forward motion of the first slide member 10, chuck guide 14, and tip 15 is prevented by the stop element 506 defined within the front barrel 5.

Releasing the knock member 8 returns the second slide member 11, lead guide tube 9, funnel-shaped member 901, and chuck 13 to the positions shown in FIG. 3*a*.

Figure 3C:
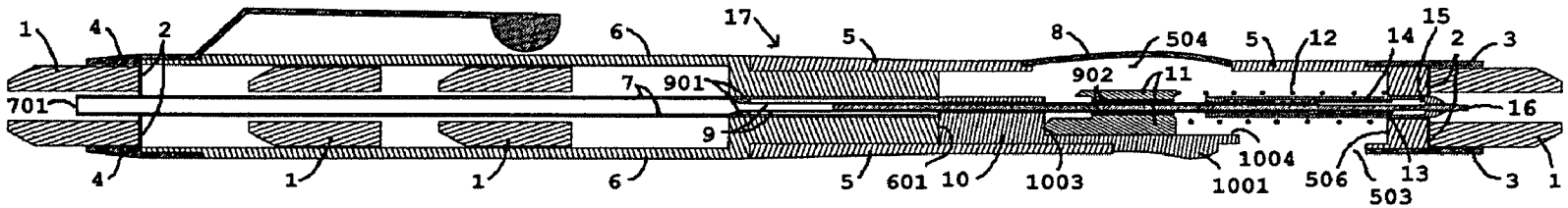
FIG. 3*c* is a cross-sectional view of the mechanical pencil assembly shown in FIG. 2 taken along the line A—A when the writing elements are retracted for erasure.

FIG. 3*c* shows a cross-sectional view of the mechanical pencil assembly 17 shown in FIG. 2 taken along the line A—A after the retraction buttons 502 (not shown) are pressed to retract the writing elements. Actuation of the retraction buttons 502 (not shown) causes the first slide member 10, chuck guide 14, tip 15, second slide member 11, lead guide tube 9, funnel-shaped member 901, chuck 13, and pencil lead 16 to move rearward with the rearward bias force of the spring 12 until the first slide member 10 contacts the stop element 601 defined on the rear barrel 6.

To return the writing elements to the projected position shown in FIG. 3*a* a forward force is applied to the knob 1001 defined on the first slide member 10 and disposed within the slider access opening 503 defined within a side of the front barrel 5 by a finger of the user.

Figure 4A:
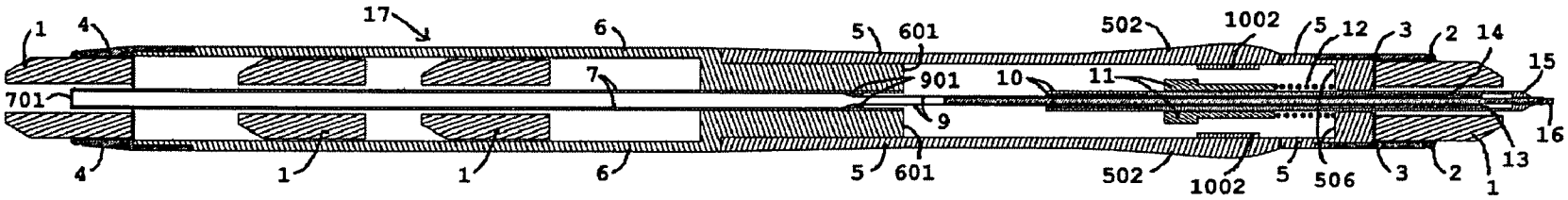
FIG. 4*a* is a cross-sectional view of the mechanical pencil assembly shown in FIG. 2 taken along the line B—B when the writing elements are projected for writing.

FIG. 4*a* shows a cross-sectional view of the mechanical pencil assembly 17 shown in FIG. 2 taken along the line B—B when the writing elements are projected. The front barrel 5 defines two retraction buttons 502 adjacent to the arms 1002 defined on the first slide member 10. Rearward motion of the writing elements is prevented by an arm lock element 505 (not shown) disposed behind each arm 1002.

Figure 4B:
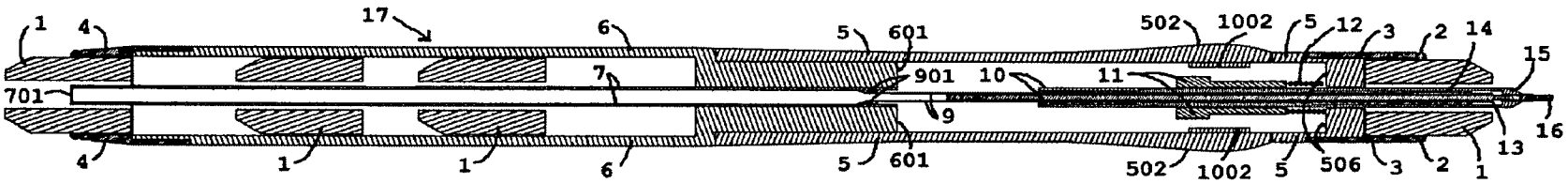
FIG. 4*b* is a cross-sectional view of the mechanical pencil assembly shown in FIG. 2 taken along the line B—B when the knock member is pressed to advance a piece of lead.

FIG. 4*b* shows a cross-sectional view of the mechanical pencil assembly 17 shown in FIG. 2 taken along the line B—B when the knock member 8 is pressed to advance a pencil lead 16.

Figure 4C:
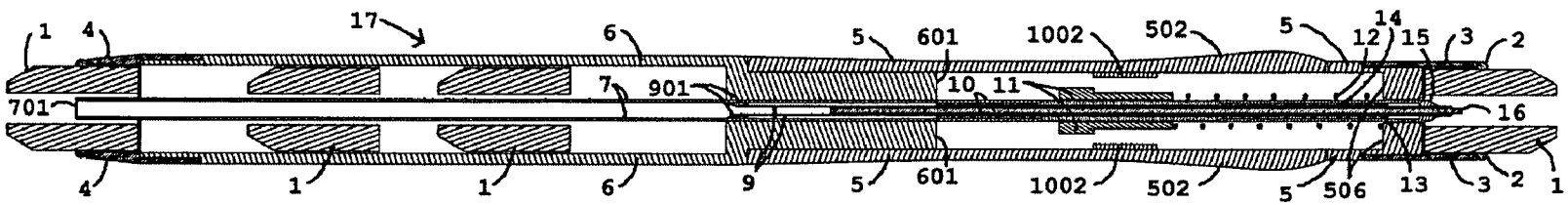
FIG. 4*c* is a cross-sectional view of the mechanical pencil assembly shown in FIG. 2 taken along the line B—B when the writing elements are retracted for erasure.
Figure 5A:
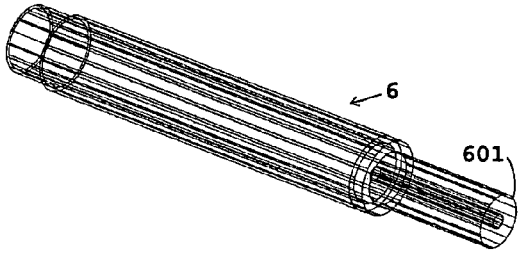
FIG. 5*a* is a perspective view from above of the rear barrel.
Figure 5B:
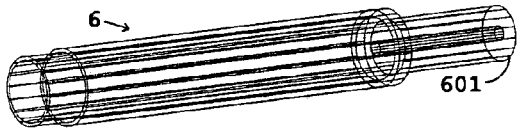
FIG. 5*b* is a perspective view from below of the rear barrel.
Figure 5C:
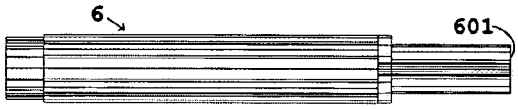
FIG. 5*c* is a side elevation view of the rear barrel.
Figure 5D:
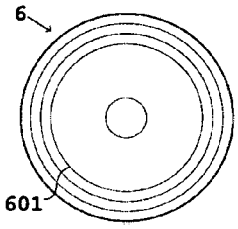
FIG. 5*d* is a front elevation view of the rear barrel.
Figure 6A:
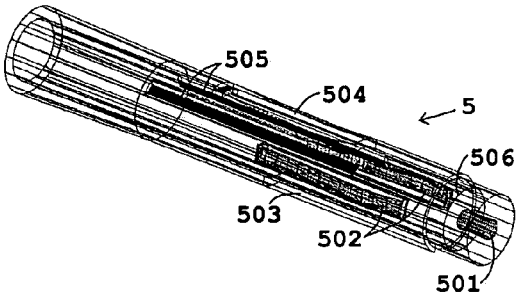
FIG. 6*a* is a perspective view from above of the front barrel.
Figure 6B:
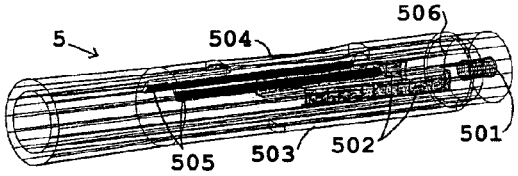
FIG. 6*b* is a perspective view from below of the front barrel.
Figure 6C:
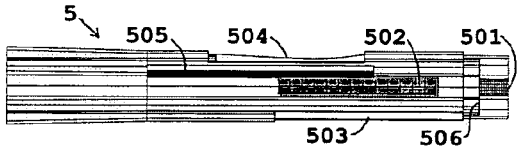
FIG. 6*c* is a side elevation view of the front barrel.
Figure 6D:
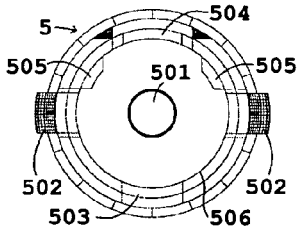
FIG. 6*d* is a front elevation view of the front barrel.
Figure 6E:
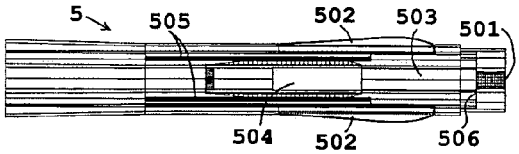
FIG. 6*e* is a top elevation view of the front barrel.
Figure 7A:
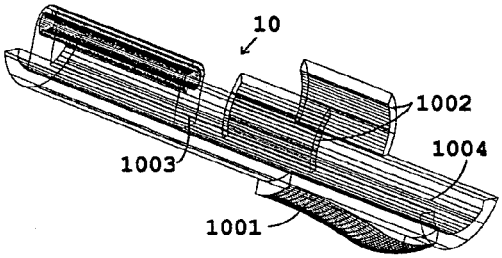
FIG. 7*a* is a perspective view from above of the first slide member.
Figure 7B:
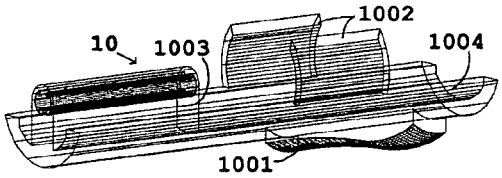
FIG. 7*b* is a perspective view from below of the first slide member.
Figure 7C:
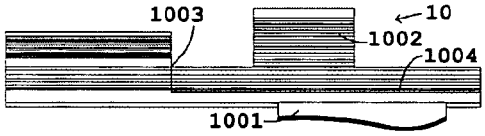
FIG. 7*c* is a side elevation view of the first slide member.
Figure 7D:
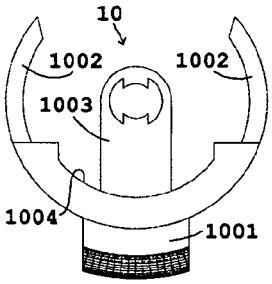
FIG. 7*d* is a front elevation view of the first slide member.
Figure 7E:
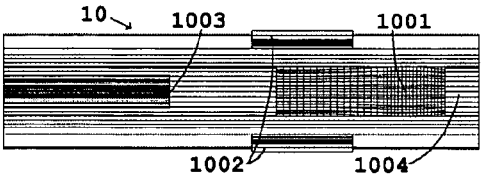
FIG. 7*e* is a top elevation view of the first slide member.
Figure 8A:
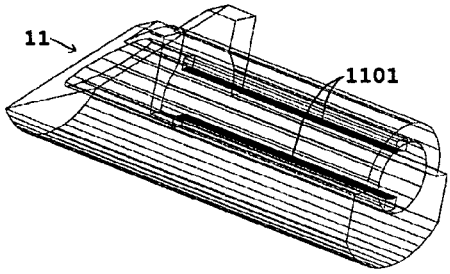
FIG. 8*a* is a perspective view from above of the second slide member.
Figure 8B:
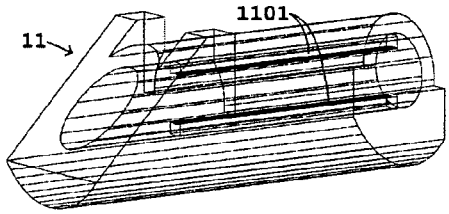
FIG. 8*b* is a perspective view from below of the second slide member.
Figure 8C:
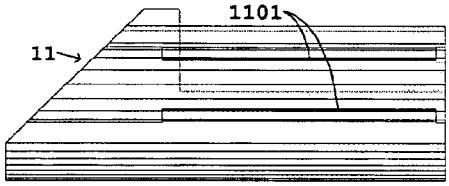
FIG. 8*c* is a side elevation view of the second slide member.
Figure 8D:
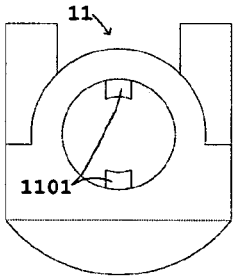
FIG. 8*d* is a front elevation view of the second slide member.
Figure 8E:
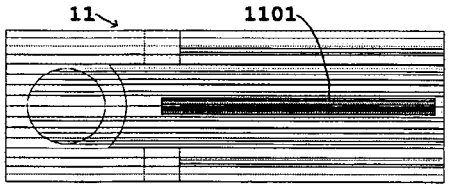
FIG. 8*e* is a top elevation view of the second slide member.
Figure 9A:
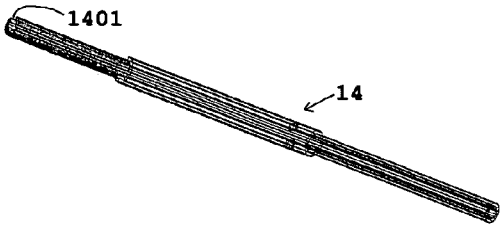
FIG. 9*a* is a perspective view from above of the chuck guide.
Figure 9B:
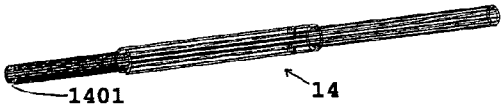
FIG. 9*b* is a perspective view from below of the chuck guide.
Figure 9C:
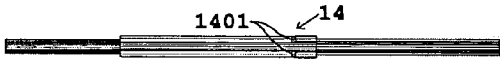
FIG. 9*c* is a side elevation view of the chuck guide.
Figure 9D:
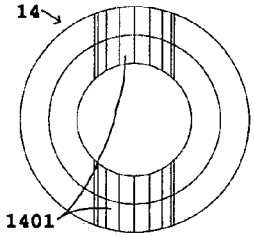
FIG. 9*d* is a front elevation view of the chuck guide.
Figure 9E:
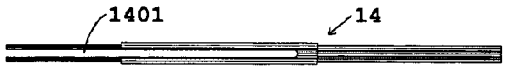
FIG. 9*e* is a top elevation view of the chuck guide.
Figure 10A:
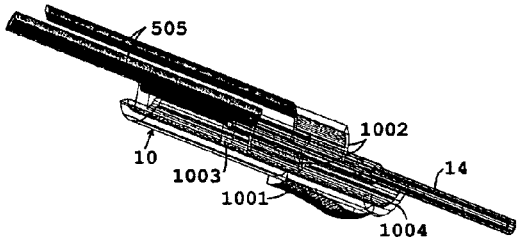
FIG. 10*a* is a perspective view from above of the assembly comprising the first slide member and chuck guide adjacent to the arm lock elements of the front barrel (front barrel not shown)
Figure 10B:
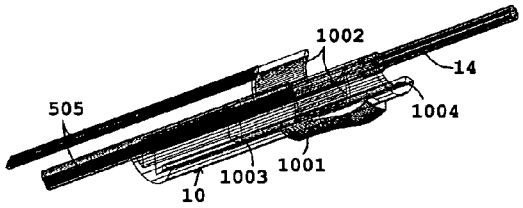
FIG. 10*b* is a perspective view from below of the said assembly adjacent to the arm lock elements.
Figure 10C:
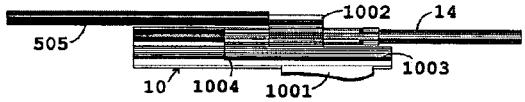
FIG. 10*c* is a side elevation view of the said assembly adjacent to the arm lock elements.
Figure 10D:
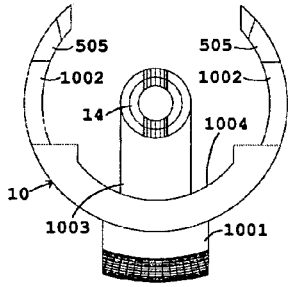
FIG. 10*d* is a front elevation view of the said assembly adjacent to the arm lock elements.
Figure 10E:
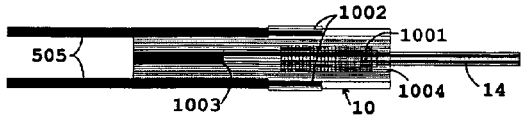
FIG. 10*e* is a top elevation view of the said assembly adjacent to the arm lock elements.
Figure 11A:
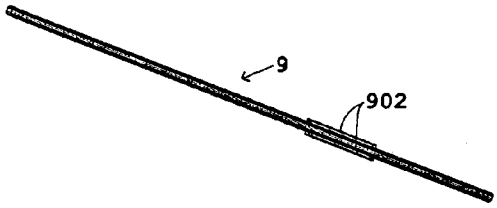
FIG. 11*a* is a perspective view from above of the lead guide tube.
Figure 11B:
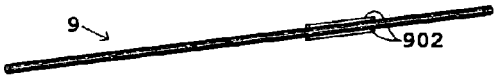
FIG. 11*b* is a perspective view from below of the lead guide tube.
Figure 11C:
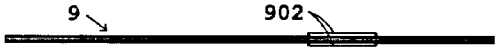
FIG. 11*c* is a side elevation view of the lead guide tube.
Figure 11D:
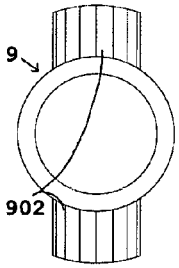
FIG. 11*d* is a front elevation view of the lead guide tube.
Figure 11E:
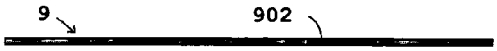
FIG. 11*e* is a top elevation view of the lead guide tube.
Figure 12A:
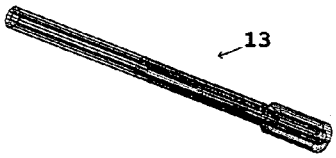
FIG. 12*a* is a perspective view from above of the chuck.
Figure 12B:
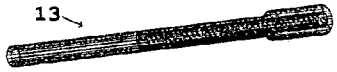
FIG. 12*b* is a perspective view from below of the chuck.
Figure 12C:
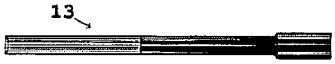
FIG. 12*c* is a side elevation view of the chuck.
Figure 12D:
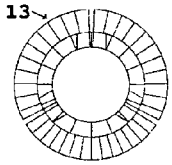
FIG. 12*d* is a front elevation view of the chuck.
Figure 13A:
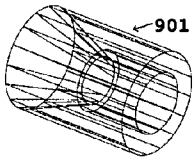
FIG. 13*a* is a perspective view from above of the funnel-shaped member.
Figure 13B:
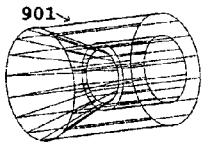
FIG. 13*b* is a perspective view from below of the funnel-shaped member.
Figure 13C:
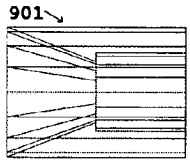
FIG. 13*c* is a side elevation view of the funnel-shaped member.
Figure 13D:
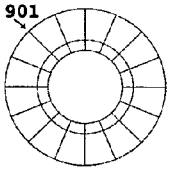
FIG. 13*d* is a front elevation view of the funnel-shaped member.
Figure 14A:
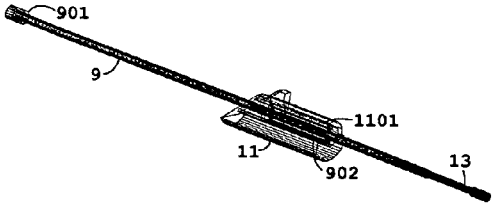
FIG. 14*a* is a perspective view from above of the assembly comprising the second slide member, lead guide tube, funnel-shaped member, and chuck.
Figure 14B:
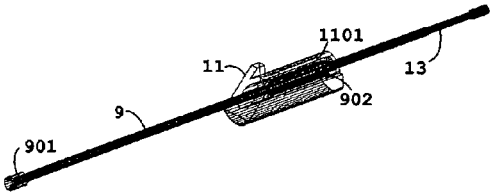
FIG. 14*b* is a perspective view from below of the said assembly.
Figure 14C:
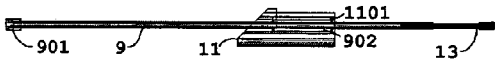
FIG. 14*c* is a side elevation view of the said assembly.
Figure 14D:
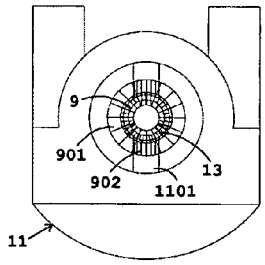
FIG. 14*d* is a front elevation view of the said assembly.
Figure 14E:
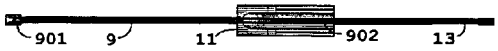
FIG. 14*e* is a top elevation view of the said assembly.
Figure 15A:
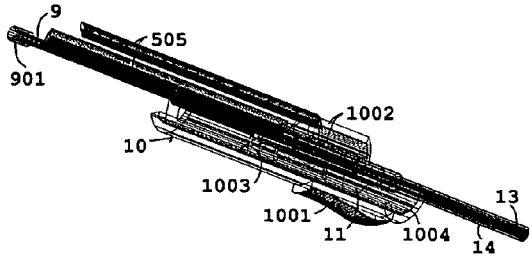
FIG. 15*a* is a perspective view from above of the assembly comprising the second slide member, lead guide, funnel-shaped member, and chuck disposed on the assembly comprising the first slide member and chuck guide adjacent to the arm lock elements of the front barrel (front barrel not shown)
Figure 15B:
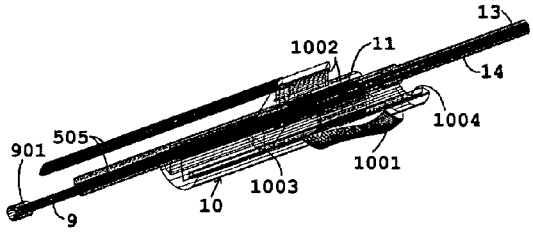
FIG. 15*b* is a perspective view from below of the said assemblies adjacent to the arm lock elements.
Figure 15C:
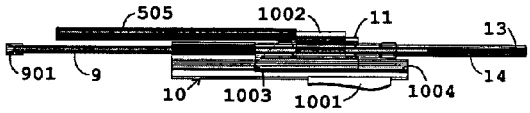
FIG. 15*c* is a side elevation view of the said assemblies adjacent to the arm lock elements.
Figure 15D:
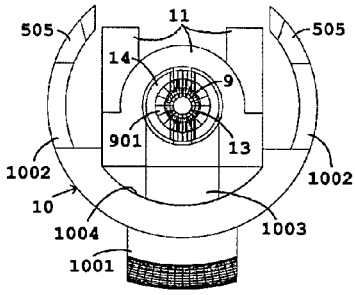
FIG. 15*d* is a front elevation view of the said assemblies adjacent to the arm lock elements.
Figure 15E:
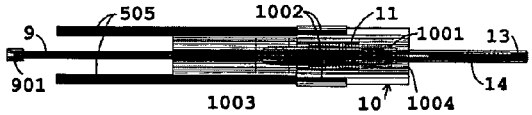
FIG. 15*e* is a top elevation view of the said assemblies adjacent to the arm lock elements.
Figure 16A:
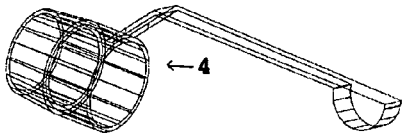
FIG. 16*a* is a perspective view from above of the rear flange.
Figure 16B:
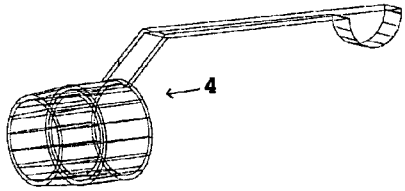
FIG. 16*b* is a perspective view from below of the rear flange.
Figure 16C:
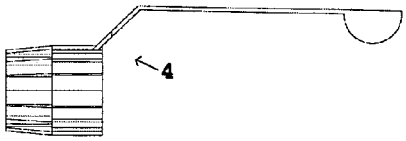
FIG. 16*c* is a side elevation view of the rear flange.
Figure 16D:
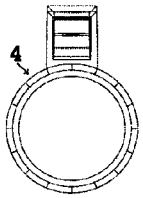
FIG. 16*d* is a front elevation view of the rear flange.
Figure 16E:
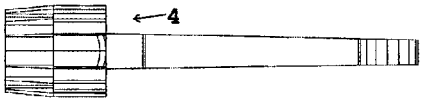
FIG. 16*e* is a top elevation view of the rear flange.
Figure 17A:
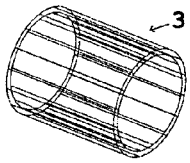
FIG. 17*a* is a perspective view from above of the front flange.
Figure 17B:
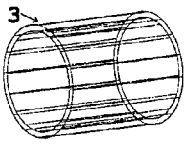
FIG. 17*b* is a perspective view from below of the front flange.
Figure 17C:
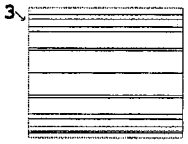
FIG. 17*c* is a side elevation view of the front flange.
Figure 17D:
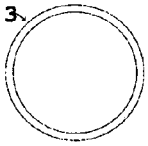
FIG. 17*d* is a front elevation view of the front flange.
Figure 18A:
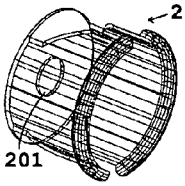
FIG. 18*a* is a perspective view from above of the eraser cup.
Figure 18B:
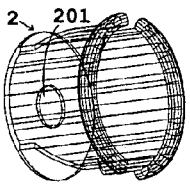
FIG. 18*b* is a perspective view from below of the eraser cup.
Figure 18C:
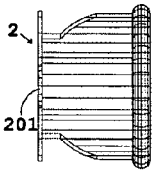
FIG. 18*c* is a side elevation view of the eraser cup.
Figure 18D:
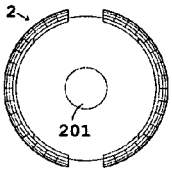
FIG. 18*d* is a front elevation view of the eraser cup.
Figure 18E:
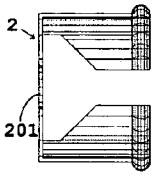
FIG. 18*e* is a top elevation view of the eraser cup.
Figure 19A:
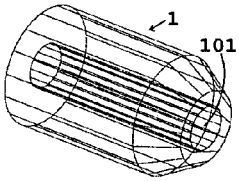
FIG. 19*a* is a perspective view from above of the tubular eraser.
Figure 19B:
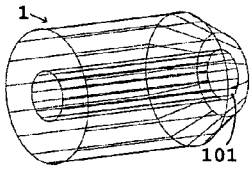
FIG. 19*b* is a perspective view from below of the tubular eraser.
Figure 19C:
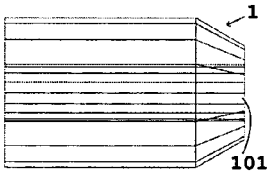
FIG. 19*c* is a side elevation view of the tubular eraser.
Figure 19D:
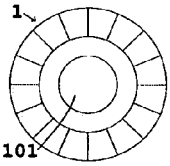
FIG. 19*d* is a front elevation view of the tubular eraser.
Figure 20A:
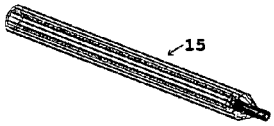
FIG. 20*a* is a perspective view from above of the tip.
Figure 20B:
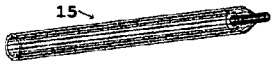
FIG. 20*b* is a perspective view from below of the tip.
Figure 20C:
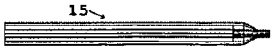
FIG. 20*c* is a side elevation view of the tip.
Figure 20D:
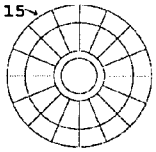
FIG. 20*d* is a front elevation view of the tip.
Figure 21A:
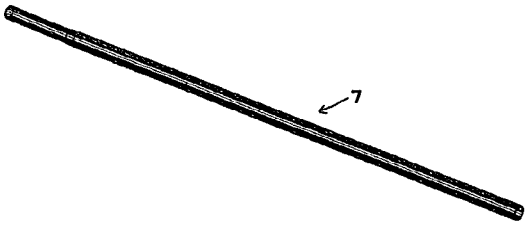
FIG. 21*a* is a perspective view from above of the lead storage tank.
Figure 21B:
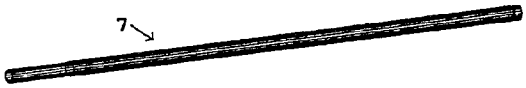
FIG. 21*b* is a perspective view from below of the lead storage tank.
Figure 21C:
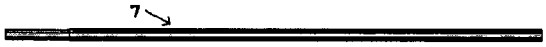
FIG. 21*c* is a side elevation view of the lead storage tank.
Figure 21D:
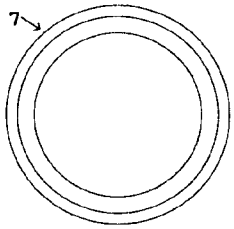
FIG. 21*d* is a front elevation view of the lead storage tank.
Figure 22A:
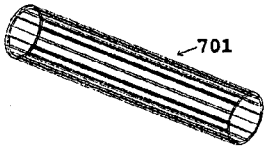
FIG. 22*a* is a perspective view from above of the tank cap.
Figure 22B:
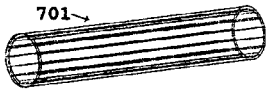
FIG. 22*b* is a perspective view from below of the tank cap.
Figure 22C:
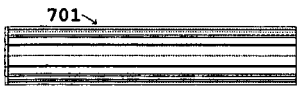
FIG. 22*c* is a side elevation view of the tank cap.
Figure 22D:
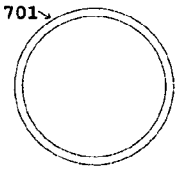
FIG. 22*d* is a front elevation view of the tank cap.
Figure 23A:
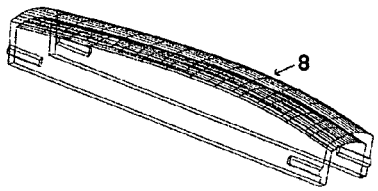
FIG. 23*a* is a perspective view from above of the knock member.
Figure 23B:
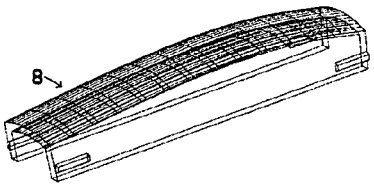
FIG. 23*b* is a perspective view from below of the knock member.
Figure 23C:
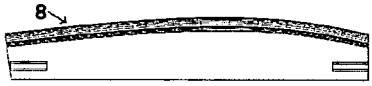
FIG. 23*c* is a side elevation view of the knock member.
Figure 23D:
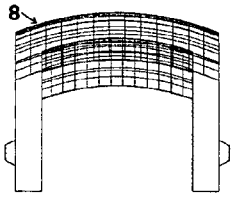
FIG. 23*d* is a front elevation view of the knock member.
Figure 23E:
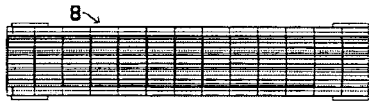
FIG. 23*e* is a top elevation view of the knock member.

FIG. 4*c* shows a cross-sectional view of the mechanical pencil assembly 17 shown in FIG. 2 taken along the line B—B after the retraction buttons 502 are pressed to retract the writing elements. Actuation of the retraction buttons 502 displaces the arms 1002 laterally away from the adjacent arm lock elements 505 (not shown), permitting substantially unimpeded rearward motion of the writing elements until the first slide member 10 contacts the stop element 601.

FIG. 5*a* through FIG. 5*d* show four views of the rear barrel 6 and the stop element 601 defined thereon for preventing rearward motion of the writing elements therebeyond.

FIG. 6*a* through FIG. 6*e* show five views of the front barrel 5. A front bore 501 is defined at the front end therethrough to permit substantially unimpeded projection and retraction of the tip 15 therethrough. The diameter of the front bore 501 is only slightly larger than the outer diameter of the tip 15 to provide lateral stability of the writing elements when writing. A knock member opening 504 is defined within a side of the front barrel 5 to permit the knock member 8 to communicate with the second slide member 11 to advance a pencil lead 16. A slider access opening 503 is defined within an opposite side of the front barrel 5 to permit a user to communicate with the first slide member 10 by contacting the first slide member 10 with a finger to project the writing elements. Two arm lock elements 505 are defined within the front barrel 5, each disposed behind an arm 1002 when the writing elements are projected in the assembled mechanical pencil assembly 17 to prevent rearward motion of the writing elements. Two retraction buttons 502 are defined on the front barrel 5, each adjacent to an arm 1002 in the assembled mechanical pencil assembly 17, such that pressing the retraction buttons 502 displaces each arm 1002 laterally away from the adjacent arm lock element 505 to permit retraction of the writing elements. A stop element 506 is defined within the front barrel 5 at a front end therewithin to prevent forward motion of the first slide member 10 therebeyond.

FIG. 7*a* through FIG. 7*e* show five views of the first slide member 10. A knob 1001 is defined on the underside thereof, which is disposed within the knock member opening 504 of the front barrel 5 in the assembled mechanical pencil assembly 17 to permit a user to contact the first slide member 10 with a finger and apply a forward force to project the writing elements. Two arms 1002 are defined on opposite sides of the first slide member 10 to prevent rearward motion of the writing elements when projected in the assembled mechanical pencil assembly 17. In the preferred embodiment of the present invention each arm 1002 is formed of a flexible material, such as plastic, that permits bending when force is applied thereto. When the writing elements are projected in the assembled mechanical pencil assembly 17 the arms 1002 are disposed in front of the arm lock elements 505 and adjacent to the retraction buttons 502, such that when the retraction buttons 502 are pressed, the arms 1002 are displaced laterally away from the arm lock elements 505 to permit rearward motion of the writing elements. A channel 1004 oriented along the axis of the mechanical pencil assembly 17 is defined on the first slide member 10, in which the second slide member 11 is disposed in the assembled mechanical pencil assembly 17. A stop element 1003 is defined at a rear end of the channel 1004 to prevent rearward motion of the second slide member 11 therebeyond. The stop element 1003 also functions as the point of securement of the chuck guide 14 to the first slide member 10.

FIG. 8*a* through FIG. 8*e* show five views of the second slide member 11 and the two projecting members 1101 defined thereon. The projecting members 1101 function as the point of securement of the lead guide tube 9 to the second slide member 11. The shape of the underside of the second slide member 11 is complimentary to the shape of the channel 1004 defined on the first slide member 10 to permit substantially unimpeded motion of the second slide member 11 thereon upon actuation of the knock member 8.

FIG. 9*a* through FIG. 9*e* show five views of the chuck guide 14 and the chuck guide opening 1401 defined thereon. The inner diameter of the chuck guide 14 is larger than the outer diameter of the lead guide tube 9 to permit the lead guide tube 9 to be disposed therein and to permit substantially unimpeded axial motion therein. The chuck guide opening 1401 provides an opening adjacent to the projecting members 902 defined on the lead guide tube 9 to permit the projecting members 902 to contact the projecting members 1101 defined on the second slide member 11 for securement of the lead guide tube 9 to the second slide member 11.

FIG. 10*a* through FIG. 10*e* show five views of the assembly comprising the first slide member 10 and chuck guide 14 in the projected position wherein the arms 1002 are disposed in front of the arm lock elements 505 (front barrel 5 not shown).

FIG. 11*a* through FIG. 11*e* show five views of the lead guide tube 9 and the projecting member 902 that secures the lead guide tube 9 to the second slide member 11 in the assembled mechanical pencil assembly 17.

FIG. 12*a* through FIG. 12*d* show four views of the chuck 13. In the assembled mechanical pencil assembly 17 the chuck 13 is secured to the front end of the lead guide tube 9 and is disposed axially within the chuck guide 14.

FIG. 13*a* through FIG. 13*d* show four views of the funnel-shaped member 901. In the assembled mechanical pencil assembly 17 the funnel-shaped member 901 is secured to the rear end of the lead guide tube 9 and is disposed axially within the lead storage tank 7 to guide a pencil lead 16 from the lead storage tank 7 to the lead guide tube 9. The outer diameter of the funnel-shaped member 901 is slightly smaller than the inner diameter of the lead storage tank 7.

FIG. 14*a* through FIG. 14*e* show five views of the assembly comprising the second slide member 11, lead guide tube 9, funnel-shaped member 901, and chuck 13.

FIG. 15*a* through FIG. 15*e* show five views of the assembly comprising the second slide member 11, lead guide tube 9, funnel-shaped member 901, and chuck 13 disposed on the assembly comprising the first slide member 10 and chuck guide 14, wherein the second slide member 11 is disposed in the channel 1004 defined on the first slide member 10 and both assemblies are in the projected positions wherein the arms 1002 defined on the first slide member 10 are disposed in front of the arm lock elements 505 (front barrel 5 not shown).

FIG. 16*a* through FIG. 16*e* show five views of the rear flange 4 that secures an eraser cup 2 to the rear end of the rear barrel 6 in the assembled mechanical pencil assembly 17.

FIG. 17*a* through FIG. 17*d* show four views of the front flange 3 that secures an eraser cup 2 to the front end of the front barrel 5 in the assembled mechanical pencil assembly 17.

FIG. 18*a* through FIG. 18*e* show five views of the eraser cup 2 that can secure a tubular eraser 1 to the rear end of the rear barrel 6 or to the front end of the front barrel 5. The diameter of the eraser cup bore 201 defined therethrough is larger than the outer diameter of the tip 15 to permit projection and retraction of the tip 15 therethrough and is larger than the outer diameter of the assembly comprising the lead storage tank 7 and tank cap 701 to permit the said assembly to be disposed therein to provide lateral stability of the said assembly. Identical eraser cups 2 can be used to secure a tubular eraser 1 to the front end of the front barrel 5 and to secure a tubular eraser 1 to the rear end of the rear barrel 6, which helps keep manufacturing costs low.

FIG. 19*a* through FIG. 19*d* show four views of the tubular eraser 1 that can be secured to the front end of the front barrel 5 and to the rear end of the rear barrel 6. The diameter of the tubular eraser bore 101 defined therethrough is larger than the outer diameter of the tip 15 to permit projection and retraction of the tip 15 therethrough. The diameter of the tubular eraser bore 101 is also larger than the outer diameter of the assembly comprising the lead storage tank 7 and tank cap 701 and the outer diameter of the tubular eraser 1 is smaller than the inner diameter of the rear barrel 6 to permit additional tubular erasers 1 to be stored within the rear barrel 6 about the lead storage tank 7. Identical tubular erasers 1 can be used at both the front and rear ends of the mechanical pencil assembly 17, which helps keep manufacturing costs low.

FIG. 20*a* through FIG. 20*d* show four views of the tip 15 that guides a pencil lead 16 out from the front end of the mechanical pencil assembly 17. In the assembled mechanical pencil assembly 17 the tip 15 is detachably secured to the front end of the chuck guide 14.

FIG. 21*a* through FIG. 21*d* show four views of the lead storage tank 7 that stores additional pencil leads 16. In the assembled mechanical pencil assembly 17 the stop element 601 defined in the rear barrel 6 also functions to secure the lead storage tank 7 axially within the rear barrel 6.

FIG. 22*a* through FIG. 22*d* show four views of the tank cap 701. In the assembled mechanical pencil assembly 17 the tank cap 701 is detachably secured to the rear end of the lead storage tank 7.

FIG. 23*a* through FIG. 23*e* show five views of the knock member 8. In the assembled mechanical pencil assembly 17 the knock member 8 is secured within a side of the front barrel 5 adjacent to the second slide member 11.

Figure 24A:
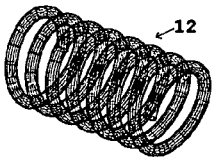
FIG. 24*a* is a perspective view from above of the spring and FIG. 24*b* is a perspective view from below of the spring.
Figure 24B:
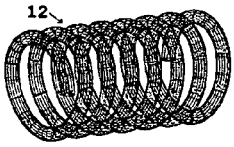

FIG. 24*a* through FIG. 24*b* show two views of the spring 12 that is provides a rearward bias force to the writing elements. In the assembled mechanical pencil assembly 17 the front end of the spring 12 contacts the stop element 506 defined within the front barrel 5 and the rear end of the spring 12 contacts the second slide member 11.

Although a specific embodiment of the present invention has been illustrated and described, many variations or modifications would be apparent that do not depart from the spirit and scope of the present invention, which are defined by the appended claims.

What is claimed is:

1. A mechanical pencil assembly comprising:

a generally cylindrical barrel extending from approximately a front end of said pencil to a rear end of said pencil, said barrel defining an inner diameter, said barrel including a front barrel and a rear barrel, a first stop element defined within said front barrel, a plurality of arm lock elements defined within said front barrel, a second stop element defined within said rear barrel, a knock member disposed on said front barrel, a lead storage tank disposed within said barrel, said tank defining an inner diameter and an outer diameter, a first slide member disposed within said barrel in a manner to be axially movable relative to said barrel, said first slide member including a stop element and a plurality of arms, a chuck disposed within said barrel to advance a pencil lead out of a front end of said front barrel upon actuation of said knock member, said chuck axially disposed within a chuck guide secured to said first slide member, a tip secured at a front end of said chuck guide to guide said pencil lead out of the front end of said mechanical pencil assembly, said tip defining an outer diameter, a second slide member disposed within said barrel in a manner to be axially movable relative to said barrel, said second slide member including a lead guide tube communicating at its front end with said chuck, said lead guide tube having a lead passageway communicating with said chuck, said lead guide tube having a funnel-shaped member at a rear end of said lead passageway, said funnel-shaped member disposed within said tank, said funnel-shaped member having an outer diameter slightly smaller than the inner diameter of said tank, and said second slide member communicating with said first slide member, wherein the forward motion of said first slide member, said chuck guide, and said tip is prevented by said first stop member, wherein the rearward motion of said first slide member, said chuck guide, said tip, said second slide member, said lead guide tube, said funnel-shaped member, said chuck, and said pencil lead is prevented by said second stop element and by the contact of said plurality of arms of said first slide member to said plurality of arm lock elements, wherein actuation of said knock member moves said second slide member forward relative to said first slide member, wherein contact of said second slide member to said stop element of said first slide member prevents rearward motion of said second slide member, said lead guide tube, said funnel-shaped member, and said chuck relative to said first slide member, a biasing member axially disposed within said front barrel and about said chuck guide and said tip to bias said first slide member, said chuck guide, said tip, said second slide member, said lead guide tube, said funnel-shaped member, said chuck, and said pencil lead rearward, a plurality of retraction buttons disposed on said front barrel, said retraction buttons disposed within sides of said front barrel, said retraction buttons communicating with said plurality of arms of said first slide member, wherein actuation of said retraction buttons displaces said plurality of arms of said first slide member away from said plurality of arm lock elements of said front barrel to permit substantially unimpeded rearward motion of said first slide member, said chuck guide, said tip, said second slide member, said lead guide tube, said funnel-shaped member, said chuck, and said pencil lead, a knob defined on said first slide member and disposed within a slider access opening defined within a side of said front barrel, said knob used to apply a forward force against the biasing force of said biasing member to return the mechanical pencil assembly to the writing mode.

2. The mechanical pencil assembly of claim 1 wherein said second slide member communcates with said first slide member via a channel oriented along the axis of said barrel defined on said first slide member.

3. The mechanical pencil assembly of claim 1 wherein said knock member is a knock lever disposed within a side of said barrel.

4. The mechanical pencil assembly of claim 1 wherein said biasing member is a spring.

5. The mechanical pencil assembly of claim 1 wherein an eraser is detachably secured to a front end of said barrel, said eraser defining a bore therethrough, said bore oriented along the axis of said barrel, and diameter of said bore larger than the diameter of said tip.

6. The mechanical pencil assembly of claim 1 wherein an eraser is detachably secured to a front end of said barrel, said eraser defining a bore therethrough, said bore oriented along the axis of said barrel, and diameter of said bore larger than both the diameter of said tip and the diameter of said tank.

7. The mechanical pencil assembly of claim 1 wherein an eraser is detachably secured to a front end of said barrel, said eraser defining a bore therethrough, said bore oriented along the axis of said barrel, diameter of said bore larger than both the diameter of said tip and the diameter of said tank, and said eraser defining an outer diameter smaller than the inner diameter of said barrel.

8. The mechanical pencil assembly of claim 1 wherein an eraser is detachably secured to a rear end of said barrel.

9. A mechanical pencil assembly comprising:

a generally cylindrical barrel extending from approximately a front end of said pencil to a rear end of said pencil, said barrel defining an inner diameter, said barrel including a front barrel and a rear barrel, a first stop element defined within said front barrel, a plurality of arm lock elements defined within said front barrel, a second stop element defined within said rear barrel, a knock member disposed on said front barrel, a first slide member disposed within said barrel in a manner to be axially movable relative to said barrel, said first slide member including a stop element and a plurality of arms, a chuck disposed within said barrel to advance a pencil lead out of a front end of said front barrel upon actuation of said knock member, said chuck axially disposed within a chuck guide secured to said first slide member, a tip secured at a front end of said chuck guide to guide said pencil lead out of the front end of said mechanical pencil assembly, said tip defining an outer diameter, a second slide member disposed within said barrel in a manner to be axially movable relative to said barrel, said second slide member including a lead guide tube communicating at its front end with said chuck, said lead guide tube having a lead passageway communicating with said chuck, said lead guide tube having a funnel-shaped member at a rear end of said lead passageway, said funnel-shaped member disposed within said barrel, said funnel-shaped member having an outer diameter slightly smaller than the inner diameter of said barrel, and said second slide member communicating with said first slide member, wherein the forward motion of said first slide member, said chuck guide, and said tip is prevented by said first stop member, wherein the rearward motion of said first slide member, said chuck guide, said tip, said second slide member, said lead guide tube, said funnel-shaped member, said chuck, and said pencil lead is prevented by said second stop element and by the contact of said plurality of arms of said first slide member to said plurality of arm lock elements, wherein actuation of said knock member moves said second slide member forward relative to said first slide member, wherein contact of said second slide member to said stop element of said first slide member prevents rearward motion of said second slide member, said lead guide tube, said funnel-shaped member, and said chuck relative to said first slide member, a biasing member axially disposed within said front barrel and about said chuck guide and said tip to bias said first slide member, said chuck guide, said tip, said second slide member, said lead guide tube, said funnel-shaped member, said chuck, and said pencil lead rearward, a plurality of retraction buttons disposed on said front barrel, said retraction buttons disposed within sides of said front barrel, said retraction buttons communicating with said plurality of arms of said first slide member, wherein actuation of said retraction buttons displaces said plurality of arms of said first slide member away from said plurality of arm lock elements of said front barrel to permit substantially unimpeded rearward motion of said first slide member, said chuck guide, said tip, said second slide member, said lead guide tube, said funnel-shaped member, said chuck, and said pencil lead, a knob defined on said first slide member and disposed within a slider access opening defined within a side of said front barrel, said knob used to apply a forward force against the biasing force of said biasing member to return the mechanical pencil assembly to the writing mode.

10. The mechanical pencil assembly of claim 9 wherein said second slide member communcates with said first slide member via a channel oriented along the axis of said barrel defined on said first slide member.

11. The mechanical pencil assembly of claim 9 wherein said knock member is a knock lever disposed within a side of said barrel.

12. The mechanical pencil assembly of claim 9 wherein said biasing member is a spring.

13. The mechanical pencil assembly of claim 9 wherein an eraser is detachably secured to a front end of said barrel, said eraser defining a bore therethrough, said bore oriented along the axis of said barrel, and diameter of said bore larger than the diameter of said tip.

14. The mechanical pencil assembly of claim 9 wherein an eraser is detachably secured to a rear end of said barrel.

* * * * *